US005676799A

United States Patent [19]

Meschenmoser et al.

[11] Patent Number: 5,676,799

[45] Date of Patent: Oct. 14, 1997

[54] EXTENDED NIP PRESS SHOE WITH ADJUSTABLE STOP

[75] Inventors: Andreas Meschenmoser, Horgenzell; Ulrich Wieland, Berg, both of Germany

[73] Assignee: Voith Sulzer Papiermaschinen GmbH, Heidenheim, Germany

[21] Appl. No.: 405,937

[22] Filed: Mar. 17, 1995

[30] Foreign Application Priority Data

Mar. 18, 1994 [DE] Germany ..... 44 09 316.0

[51] Int. Cl.[6] ..... D21F 3/02

[52] U.S. Cl. ..... 162/358.3; 162/361; 492/7

[58] Field of Search ..... 162/358.3, 358.4, 162/358.5, 361; 492/7

[56] References Cited

U.S. PATENT DOCUMENTS

| | | | |
|---|---|---|---|
| 4,514,887 | 5/1985 | Rauf et al. . | |
| 4,556,454 | 12/1985 | Dahl et al. | 492/7 |
| 4,917,767 | 4/1990 | Ilmarinen et al. | 162/358.3 |
| 5,071,513 | 12/1991 | Bluhm et al. | 162/358.5 |
| 5,084,137 | 1/1992 | Ilmarinen et al. | 162/272 |
| 5,223,100 | 6/1993 | Schiel et al. | 162/358.3 |
| 5,302,252 | 4/1994 | Gotz | 162/358.5 |

FOREIGN PATENT DOCUMENTS

| | | |
|---|---|---|
| 0345500 | 11/1992 | European Pat. Off. . |
| 0345501 | 11/1992 | European Pat. Off. . |
| 3317457 | 11/1984 | Germany . |
| 3503371 | 3/1986 | Germany . |
| 2112086 | 7/1983 | United Kingdom . |
| 9117308 | 11/1991 | WIPO . |

*Primary Examiner*—Karen M. Hastings
*Attorney, Agent, or Firm*—Greenblum & Bernstein, P.L.C.

[57] ABSTRACT

Device for handling a fiber web. The invention pertains to a device for the treatment of a fiber web, the device having an elongated press gap, wherein at least one press area is formed of a band which is pressure-impacted by at least one piston-cylinder unit, via a hydraulic contact pressure apparatus consisting of at least one support element, with a ready supply of fluid under pressure being assured for the bearing pockets of the support element in that one of the elements of the piston-cylinder unit is fixedly connected with a support portion, with the support element, together with the other one of the elements of the piston-cylinder unit being movably retained in the press direction and in the web moving direction on the one of the elements and wherein the support element is braced via a stop attached to the support portion.

18 Claims, 2 Drawing Sheets

EXTENDED NIP PRESS SHOE WITH ADJUSTABLE STOP

CROSS REFERENCE TO RELATED APPLICATIONS

This application claims the priority of German Application No. DE-P 4409316.0, filed Mar. 18, 1994, the disclosure of which is incorporated herein by reference in its entirety.

BACKGROUND OF THE INVENTION

1. Field of the Invention

This invention pertains to a device for handling a fiber web wherein two press surfaces, which combine to form an elongated press gap, exert a treatment pressure upon the fiber web, wherein at least one press surface is formed by an impermeable band movable in a web moving direction, wherein the band is pressable, via a hydraulic contact pressure apparatus, against the opposing press surface and wherein the contact pressure apparatus consists of at least one support element, with the support element in turn including at least one hydraulically actuated piston-cylinder unit, consisting of two elements, acting on the opposing press surface. The invention is particularly useful for the dehydration and finishing of a paper web.

2. Discussion of the Background of the Invention and Material Information

Devices of this type whose object or purpose it is to simplify the constructional design and assembly thereof are set forth in European Patent Publications EP 0 345 500 B1 and EP 0 345 501 B2. Therein, a support shoe is carried without a rigid mechanical connection, by piston rods, and horizontally supported by a bearing. Due to the absence of the mechanical connection, the supplying of pressurized fluid to the hydrostatic bearing pockets of the support shoe becomes very difficult.

It is the task or object of this invention to produce a device for handling a fiber web which, in addition to the benefits of the noted state of the art, also assures a ready supply and connection of pressurized fluid to the bearing pockets of the support element.

SUMMARY OF THE INVENTION

The task or object of this invention is achieved via a device for the treatment of a fiber web wherein two press surfaces, which combine to form an elongated press gap, exert a treatment pressure upon the fiber web, wherein at least one press surface is formed by an impermeable band movable in a web moving direction, wherein the band is pressable, via a hydraulic contact pressure apparatus, against the opposing press surface and wherein the contact pressure apparatus consists of at least one support element, with the support element in turn including at least one hydraulically actuated piston-cylinder unit, consisting of two elements, acting on the opposing press surface, wherein one of the elements of the piston-cylinder unit is fixedly secured to a support portion, and wherein the support element, together with the other one of the elements of the piston-cylinder unit, is movably secured relative to the piston-cylinder unit in the press direction, on the one of the elements of the piston-cylinder unit and wherein the support element is braced via a stop attached to the support portion.

In a further embodiment of the device of this invention, the contact pressure apparatus includes one of a single support element pressurized via a plurality of piston-cylinder units and a plurality of support elements, with each of the support elements being pressurized via at least one piston-cylinder unit.

In another embodiment of the device of this invention, the pressure chamber of the piston-cylinder unit is sealed via at least one disk fixed in the press direction, with the disk extending transversely to the press direction and being movable in a web moving direction, relative to one of the elements of the piston-cylinder unit, with the disk also being restrained in the press direction by the one of the elements.

In a differing embodiment of the device of this invention, the impermeable band is hydrodynamically supported via the contact pressure apparatus.

In yet a further embodiment of the device of this invention, the impermeable band is hydrostatically supported via the contact pressure apparatus.

In yet another embodiment of the device of this invention, the support device includes one of bearing pockets and openings of bores in a contact surface facing impermeable band.

In yet a differing embodiment of the device of this invention, one of the bearing pockets and the openings of the bores are operatively connected with the pressure chambers of the piston-cylinder units.

In a still further embodiment of the device of this invention, the location of the stop is adjustable, relative to its end position, in the web moving direction.

In still another embodiment of the device of this invention, the contact pressure apparatus forms a concave contact pressure surface and wherein the opposing surface is a rotating mating roller.

In still a differing embodiment of the device of this invention, the support element includes at least two piston-cylinder units arranged in tandem along the web moving direction, and wherein the piston-cylinder units can be provided with variable pressures.

In a final embodiment of the device of this invention, the support element includes several piston-cylinder units arranged laterally relative to the web moving direction, and wherein the piston-cylinder units can be provided with variable pressures.

Since one of the two elements of the piston-cylinder unit is fixedly secured to a carrier portion journalled in a seat, and since the support element, having the other of the piston-cylinder unit attached thereto, is movably retained or located in both the press and web moving directions and is retained on the element attached to the carrier, this permits a ready and simple supply of the pressure fluid from the pressure chamber of the piston-cylinder unit to the contact surfaces of the support element attached thereto.

The support element is supported or bounded at a stop attached to the carrier portion.

Since both of the elements of the piston-cylinder unit are movable relative to each other in two planes, a special form of sealing of the pressure chamber, which is formed by the two elements, becomes necessary. This can preferably be accomplished via at least one sealing disk fixed in the press direction, with the disk extending transversely to the press direction and being movable in the web moving direction, relative to one of the elements of the piston-cylinder unit, with the disk also being retained in the press direction by the one of the elements.

Lubrication of the band can be accomplished hydrodynamically and/or hydrostatically via the contact pressure apparatus. As long as such hydrostatic lubrication is present, there is the possibility, via the design of this invention, for supplying the bearing pockets of the contact surface of the support element, facing the band, via a connection with the pressure chambers of the piston-cylinder units.

If the web is damaged via observed impressions of the web into the bearing pockets, due to irregular web thickness increases, it will be of advantage to replace the bearing pockets with one or more bores that emanate from the contact surface of the support element and are operatively connected with the corresponding pressure chamber.

In one of the preferred embodiments of this invention the contact pressure apparatus takes the form of a concave pressure area and the oppositely located press surface is a rotating mating or counter roller.

In order to influence the control pressure profile, in the web moving direction, it is preferred that the support element include at least two piston-cylinder units that are arranged in tandem in the web moving direction and can be provided with variable pressures. As long as several piston-cylinder units, arranged laterally relative to the web moving direction, are utilized the possibility exists for adjusting the contact pressure profile, transversely to the web moving direction, by varying the pressure supply.

A correction of the contact pressure profile is however also possible if the stop, relative to its end position, is adjustable.

BRIEF DESCRIPTION OF THE DRAWINGS

The invention will be better understood and objects other than those set forth above will become apparent when consideration is given to the following detailed description, which is made with reference to two preferred embodiments thereof. Such description makes reference to the annexed drawings wherein throughout the various figures of the drawings, there have generally been used the same reference characters to denote the same or analogous components and wherein.

DETAILED DESCRIPTION OF THE PREFERRED EMBODIMENTS AND BEST MODE

Figure 1:
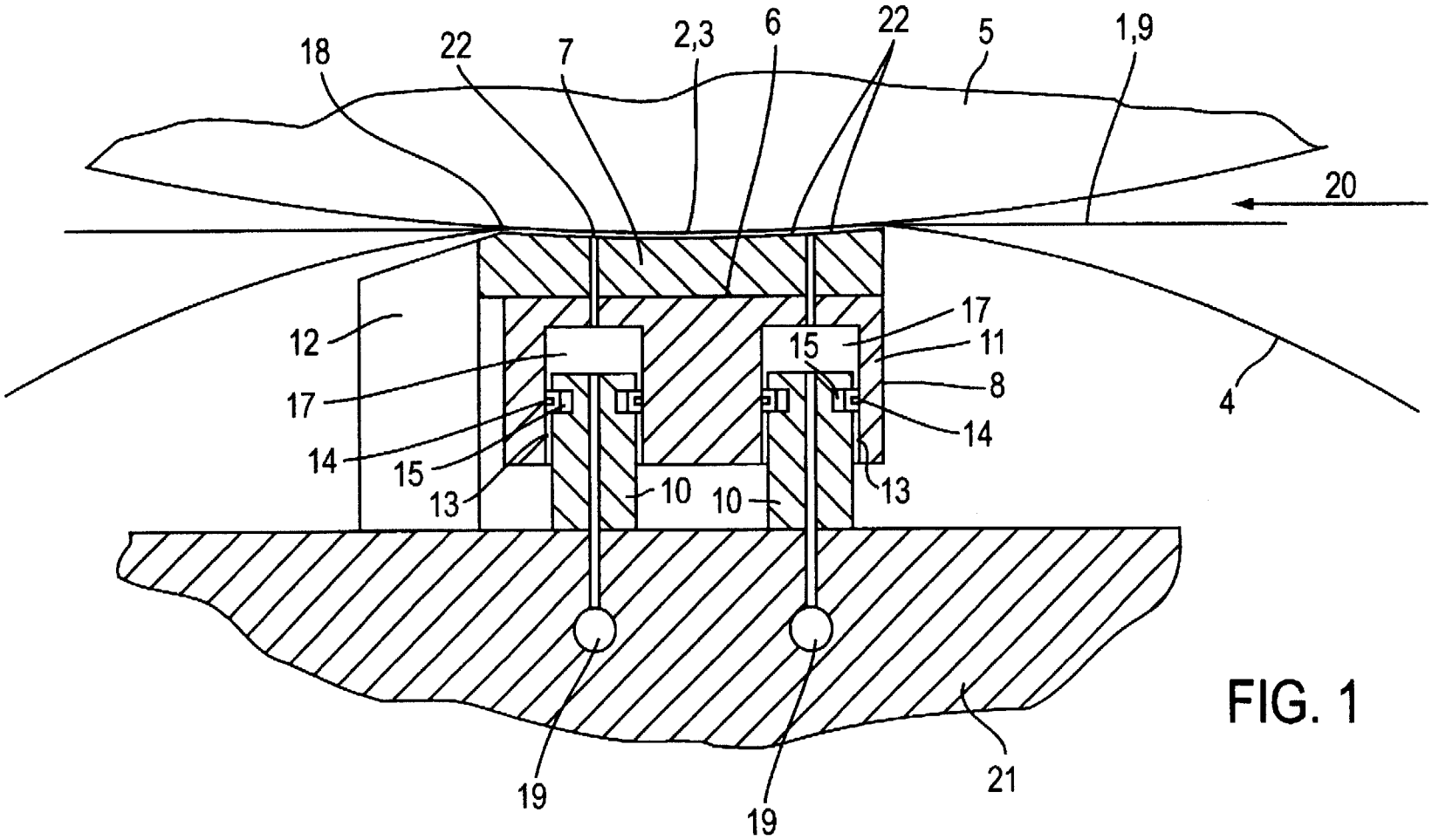
FIG. 1 is a partial sectional view of the roller of this invention, viewed in the web moving direction.

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

Both embodiments of this invention pertain to a device or apparatus for the dehydration of a fiber web 1 via two press areas or surfaces 2 and 3, with press surfaces 2, 3 forming an elongated press gap or nip and exerting the dehydration pressure upon fiber web 1, wherein first press surface 2 is formed by an impermeable or impervious band 20 movable in the web moving direction and second press surface 3 is formed by a rotating mating or counter roller 5. Fiber web 1, together with a porous band 9 is conveyed through the press gap, with band 9 being suited for at least the reception of the water being pressed thereagainst. Band 4 is pressable against oppositely located press area 3 via a hydraulic pressure exerting device or contact pressure apparatus 6. In a finishing operation only the porous band would be deleted.

Pressing or pressure exerting device 6 consists of at least one support element 7, which forms a concave contact pressure surface and which utilizes at least one hydraulic pressure medium actuated piston-cylinder unit 8 acting toward press area 3. Herein, it is entirely feasible that, laterally to web moving direction 20, several support elements 7 are arranged side by side and which in turn also have, lateral to web moving direction 20, several side by side piston-cylinder units.

In the embodiment illustrated in FIG. 1, support element 7 includes two piston-cylinder units 8, that are arranged in tandem in the web moving direction 20, which can be separately supplied, with differing pressures, via a supply conduits 19 arranged in support portion 21. In this embodiment, pistons 10 of piston-cylinder unit 8 are rigidly or fixedly connected with a seat of journalled support portion 21 of the dehydration apparatus. Support element 7 is located, with both cylinders 11 affixed thereto, on pistons 10 and is movable in both the press and in web moving direction 20.

Figure 2:
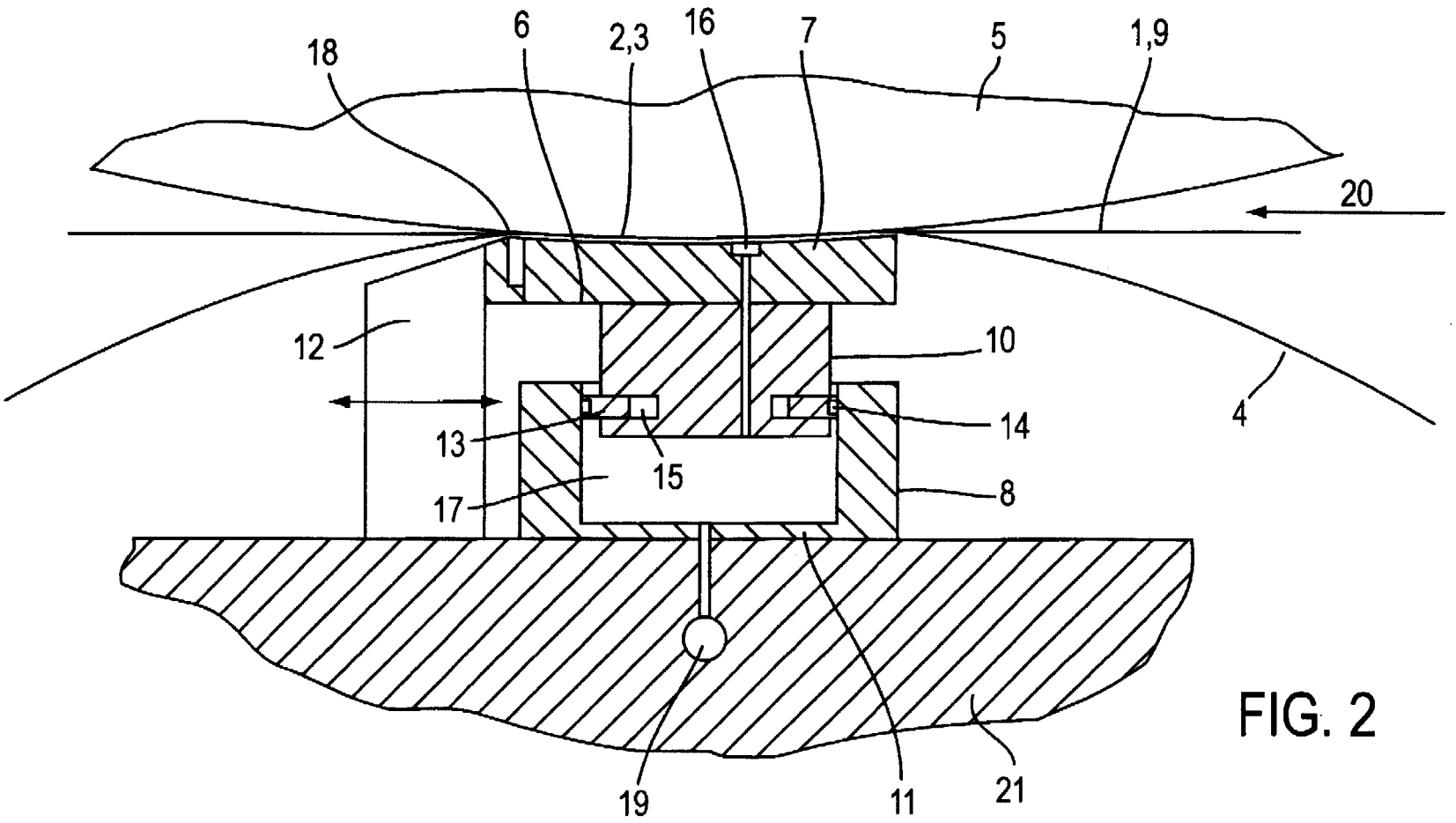
FIG. 2 is another embodiment of this roller.

In contrast thereto, FIG. 2 illustrates a support element 7 that utilizes but a single piston-cylinder unit 8, when viewed in web moving direction 20, whereby here also several piston-cylinder units 8 can be utilized for influencing the contact pressure profile, with these piston-cylinder units being laterally arranged with reference to the web moving direction. In addition, in this embodiment, cylinder 11 is rigidly attached to support portion 21. Correspondingly, support element 7, with piston 10 attached thereto, is slidingly received in cylinder 11 and movable in both the press direction and in web moving direction 20.

The sealing of pressure chamber 17 of each corresponding piston-cylinder unit 8 is achieved in both instances via a disk 13 extending laterally, relative to the press direction, and movable, in web moving direction 20, relative to piston 10 and fixed in the press direction. For this purpose, apertured disk 13 is received in a recess 15 within piston 10, with recess 15 having sufficient clearance so as to permit some movement of disk 13 in web moving direction 20. In addition, disk 13, at the abutment area relative to its associated cylinder 11, has an additional sealing element 14. A supply of pressurized medium is provided via a supply conduit 19 in support portion 21, with conduit 19 being operatively connected with pressure chamber 17 in piston 10 via an aperture in cylinder 11.

Since support element 7 is movable in web moving direction 20 within defined limits, it can adapt itself accordingly relative to opposed press surface 3. An end limit or stop is hereby provided via a stop 12 affixed to support portion 21.

Stop 12, as is illustrated in FIG. 2 relative to the local location of the abutment area in web moving direction 20, can be of variable construction, so that the contact pressure profile can be influenced through the positioning of the support element.

Impervious or impermeable band 4 is both hydrodynamically and hydrostatically lubricated via contact pressure device 6. For this reason, support element 7 can be provided, at the upper surface, facing band 4, in a direction lateral to web moving direction 20, with at least one bearing pocket 16. These bearing pockets 16 are operatively connected with pressure chambers 17 of piston-cylinder units 8, whereby, bearing pocket 16 of the embodiment illustrated in FIG. 1, can be replaced with one or more openings of bores 22 having a diameter of preferably 1 to 2 mm, which should prevent any damage to band 4.

Since the pressure medium is heated during its journey along support element 7, it is of advantage, for the protection or conservation of the generally temperature sensitive band 4, that, for example, at the web exit end of pressure contact apparatus 6, the pressure medium is removed via a scraper or remover 18, as shown in FIG. 2. During the further course of operation, bend 4 can also be cooled via the spraying on of accordingly temperature-controlled pressure or lubricating media.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of any element which is not specifically disclosed herein.

What is claimed is:

1. A device for the treatment of a fiber web comprising:

two press surfaces for forming an elongated press web to exert a treatment pressure upon the fiber web;

at least one press surface formed by an impermeable band movable in a web moving direction, the impermeable band is pressable, via a hydraulic contact pressure apparatus, against an opposing press surface;

the contact pressure apparatus comprising at least one support element, the support element including at least one hydraulically actuated piston-cylinder unit;

the piston-cylinder unit comprising two elements, acting on the opposing press surface, one of the two elements of the piston-cylinder unit is fixedly secured to a support portion;

the support element, together with an other one of the two elements of the piston-cylinder unit, is movably secured relative to the piston-cylinder unit in a press direction and to the one element;

the support element is braced via a stop attached to the support portion, the stop restricting movement of the support element in the web moving direction; and a device for adjusting the location of the stop, relative to its end position, in the web moving direction, wherein the pressure chamber of the piston-cylinder unit is sealed via least one disk fixed in the press direction, with the disk extending transversely to the press direction and being movable in a web moving direction, relative to one of the elements of the piston-cylinder unit, with the disk also being restrained in the press direction by the one element.

2. The device of claim 1, wherein the impermeable band is hydrostatically supported via the contact pressure apparatus.

3. The device of claim 2, wherein the support device includes one of bearing pockets and openings of bores in a contact surface facing impermeable band.

4. The device of claim 3, said wherein one of the bearing pockets and the openings of the bores are operatively connected with the pressure chambers of the piston-cylinder units.

5. The device of claim 2, further including a device for adjusting the location of the stop, relative to its end position, in the web moving direction.

6. The device of claim 3, further including a device for adjusting the location of the stop, relative to its end position, in the web moving direction.

7. The device of claim 2, wherein the contact pressure apparatus forms a concave contact pressure surface and wherein the opposing surface is a rotating mating roller.

8. The device of claim 3, wherein the contact pressure apparatus forms a concave contact pressure surface and wherein the opposing surface is a rotating mating roller.

9. The device of claim 4, wherein the contact pressure apparatus forms a concave contact pressure surface and wherein the opposing surface is a rotating mating roller.

10. The device of claim 1, wherein the contact pressure apparatus forms a concave contact pressure surface and wherein the opposing surface is a rotating mating roller.

11. The device of claim 2, wherein the at least one piston-cylinder unit includes at least two piston-cylinder units arranged in tandem along the web moving direction, and wherein the piston-cylinder units can be provided with variable pressures.

12. The device of claim 3, wherein the at least one piston-cylinder unit includes at least two piston-cylinder units arranged in tandem along the web moving direction, and wherein the piston-cylinder units can be provided with variable pressures.

13. The device of claim 4, wherein the at least one piston-cylinder unit includes at least two piston-cylinder units arranged in tandem along the web moving direction, and wherein the piston-cylinder units can be provided with variable pressures.

14. The device of claim 1, wherein the at least one piston-cylinder unit includes at least two piston-cylinder units arranged in tandem along the web moving direction, and wherein the piston-cylinder units can be provided with variable pressures.

15. The device of claim 2, wherein the at least one piston-cylinder unit includes several piston-cylinder units arranged laterally relative to the web moving direction, and wherein the piston-cylinder units can be provided with variable pressures.

16. The device of claim 3, wherein the at least one piston-cylinder unit includes several piston-cylinder units arranged laterally relative to the web moving direction, and wherein the piston-cylinder units can be provided with variable pressures.

17. The device of claim 4, wherein the at least one piston-cylinder unit includes several piston-cylinder units arranged laterally relative to the web moving direction, and wherein the piston-cylinder units can be provided with variable pressures.

18. The device of claim 1, wherein the at least one piston-cylinder unit includes several piston-cylinder units arranged laterally relative to the web moving direction, and wherein the piston-cylinder units can be provided with variable pressures.

* * * * *